United States Patent [19]

Adachi et al.

[11] 4,432,942

[45] Feb. 21, 1984

[54] APPARATUS FOR FILLING A CONTAINER WITH RADIOACTIVE SOLID WASTES

[76] Inventors: Toshio Adachi, 63 Omotedai Tenpaku-ken, Nagoya-shi, Aichi-ken; Susumu Hiratake, 1662-9 Kizuki-cho, Kasugai-shi, Aichi-ken, both of Japan

[21] Appl. No.: 310,719

[22] Filed: Oct. 13, 1981

[30] Foreign Application Priority Data

Jan. 27, 1979 [JP] Japan ..... 54-8325

[51] Int. Cl.[3] ..... G21F 9/30

[52] U.S. Cl. ..... 422/159; 219/121 PA; 219/121 PB; 250/506.1; 252/626; 266/900; 266/901

[58] Field of Search ..... 219/121 PA, 121 PB; 250/506; 264/0.5; 252/201.1 W; 266/900, 901; 422/159

[56] References Cited

U.S. PATENT DOCUMENTS

| | | | |
|---|---|---|---|
| 3,153,566 | 10/1964 | Spector | 252/301.1 W |
| 3,365,578 | 1/1968 | Grover et al. | 250/106 |
| 3,779,182 | 12/1973 | Comacho | 110/8 R |
| 3,894,573 | 7/1975 | Paton et al. | 13/2 P |
| 4,058,479 | 11/1977 | White et al. | 422/159 X |
| 4,145,396 | 3/1979 | Grantham | 423/22 |
| 4,313,845 | 2/1982 | Cowan et al. | 422/159 X |

FOREIGN PATENT DOCUMENTS 2424697 5/1974 Fed. Rep. of Germany ..... 250/506

OTHER PUBLICATIONS

"Radioactive Waste Disposal", Gilmore, Noyes Data Corp., Park Ridge, NJ, 1977, pp. 117, 118.

*Primary Examiner*—Robert L. Lindsay, Jr.
*Attorney, Agent, or Firm*—William A. Drucker

[57] ABSTRACT

In apparatus for filling a container suitable for storage with radioactive solid wastes arising from atomic power plants or the like, a plasma arc is irradiated toward a portion of the wastes to melt the portion of the wastes; portions of the wastes are successively moved so as to be subjected to irradiation of the plasma arc to continuously melt the wastes; and the melts obtained by melting the wastes are permitted to flow down toward the bottom of the container.

5 Claims, 4 Drawing Figures

APPARATUS FOR FILLING A CONTAINER WITH RADIOACTIVE SOLID WASTES

BACKGROUND OF THE INVENTION

This invention relates to the filling of a container, for the purpose of storage, with radioactive wastes, particularly, miscellaneous incombustible solid wastes, arising from atomic power plants or other establishments for handling radioactive materials.

Since in such radioactive wastes, the radioactive rays emitted therefrom exert a great influence upon living things in the natural world including humankind, the wastes need be stored until the final disposal (for example, such as dumping into the seas or burying under the ground) has been done. In this case, it involves a problem that the wastes as described above are generally so bulky that a very large storing space must be provided if the wastes are stored without modification. In order to eliminate the aforesaid problem, it has been conceived to reduce the wastes into small pieces so as to fill a container with thus reduced wastes. However, even in such a case, clearances are formed between these reduced pieces within the container, resulting in a limited reduction in the quantity capable of being filled.

The present inventor has also conceived an apparatus in which such wastes are melted in a crucible of a high frequency induction furnace or an arc furnace, the furnace body being tilted to transfer the molten wastes into a solidifying container for solidification, and the solidified wastes being transferred into a storing container for storage. However, this requires much labor during the operation.

OBJECTS OF THE INVENTION

An object of this invention is to provide an apparatus for reducing the volume of bulky radioactive wastes having various shapes so that the wastes can be stored in a convenient manner.

Another object of this invention is to provide an apparatus for reducing the volume of wastes and providing the whole of the wastes with a predetermined or uniform shape in a simultaneous manner, i.e. to pack wastes having different shapes to the full into a container having a uniform shape and solidify the wastes in the fully-packed condition. The wastes melted and solidified in the container are reduced in volume, and a predetermined shape is simultaneously given to the whole of the wastes since the container has a uniform shape. This feature of the invention provides many advantages, such as ease in storing the solidified waste and the like.

A further object of this invention is to provide an apparatus which is adapted to prevent any environmental pollution when and if melted radioactive wastes are scattered during the melting of the wastes in a container, i.e. the apparatus herein is such that wastes are put into a container, for storing the wastes, in advance, and the wastes are melted by plasma arcs in this condition, i.e., surrounded by the walls of the container. Therefore, when any portion of the melted wastes is scattered, most of it is prevented from going out of the container by the walls thereof so that environmental pollution due to a scatter of the radioactive wastes can be minimized.

A further object of this invention is to provide an apparatus which makes it possible to melt radioactive wastes with a higher thermal efficiency by positioning the wastes and a plasma torch, for heating the wastes, to each other in a melting-efficient manner whether the wastes in the container happen to be located nearer to the bottom of the container or to the top of the container. The apparatus herein employs a plasma torch, i.e., a device capable of heating wastes in a local and concentrated manner by emitting highly linear plasma arcs, as a means for heating wastes. The plasma torch can be moved in a vertical direction, and has a lower end adapted to come into a container, so that the wastes, regardless of their vertical position in the container, can be irradiated by the plasma torch by moving the torch in a vertical direction. Therefore, the wastes can be melted with a higher thermal efficiency in any case.

A still further object of this invention is to provide an apparatus which makes it possible to use a container having a simple construction, prevent the container from being melted when wastes are melted therein, and employ a simple means for protecting the container against heat.

Having the above-mentioned construction, the apparatus according to the invention can melt wastes in a container in a concentrated manner. Therefore, wastes can be melted with a minimum danger of melting of the container.

The container can be filled in its required space with the radioactive wastes with high density and in all parts thereof closely. The radioactive wastes are heated to be molten, and the melt is introduced into the container in orderly fashion from the bottom thereof and accordingly, the container is filled in its required space with the wastes with little clearance. The radioactive wastes can be decreased in volume through that portion. Consequently, in the event after the container has been filled, the radioactive wastes filled in the container are stored, a small site required for the storage thereof will suffice. Further, the radioactive wastes can be filled into the container in its required space with little clearance, and so, even if a given quantity of radioactive wastes are required to be filled in that required space, it is possible to easily meet the requirement.

The container can be filled for storing the radioactive wastes with the radioactive wastes in a state of high density as described above, merely by the operation of principally melting the radioactive wastes. The operation of melting the radioactive wastes is all that is required to minimize bulking thereof, and as a consequence, the operation of filling the container for storing the radioactive wastes with the wastes with high density can be simultaneously effected without requiring much labor.

Other objects and advantages of the invention will become apparent during the following discussion of the accompanying drawings.

DESCRIPTION OF THE PREFERRED EMBODIMENTS

Figure 1:
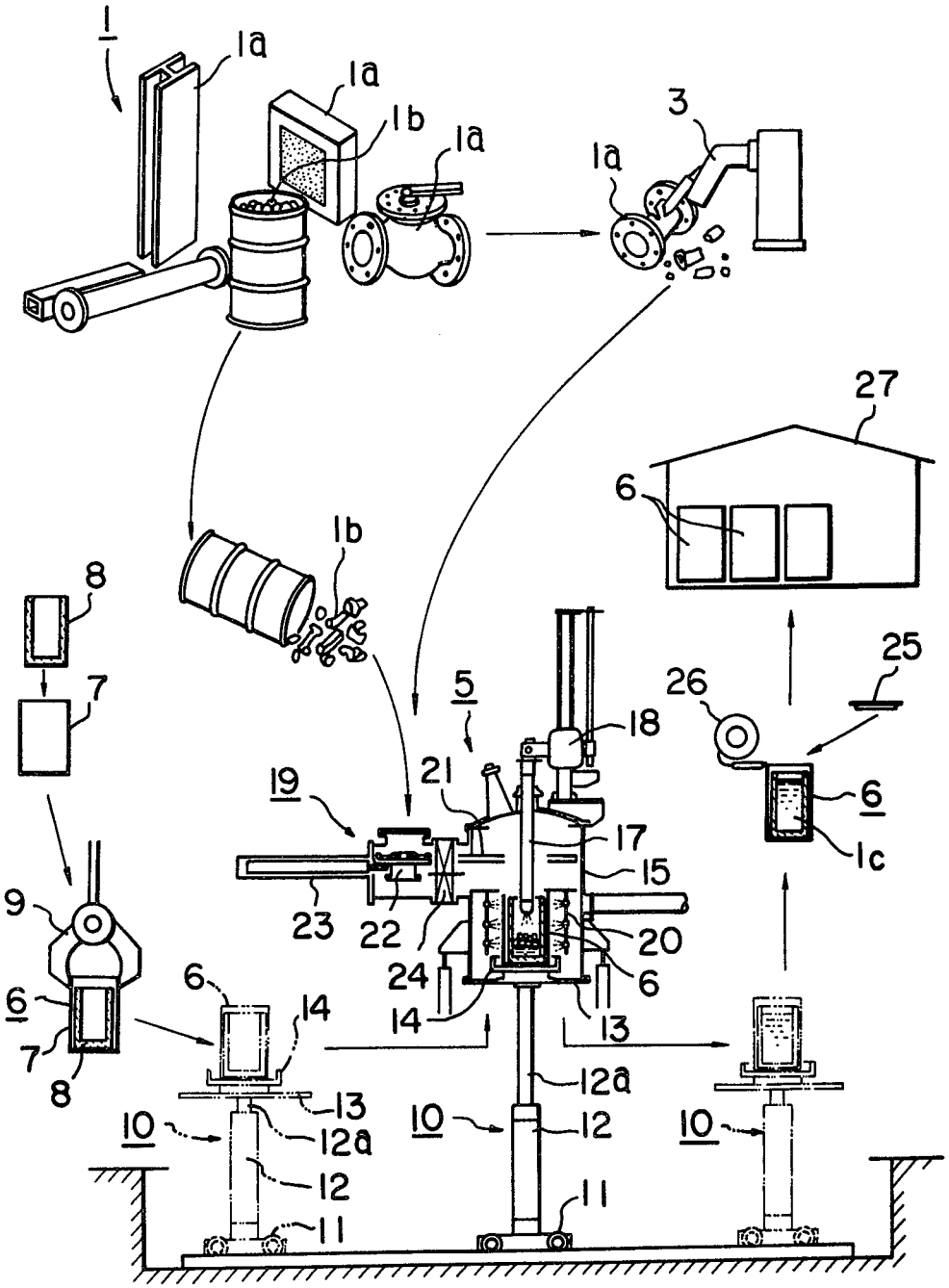
FIG. 1 illustrates the process of treatment of radioactive wastes.
Figure 2A:
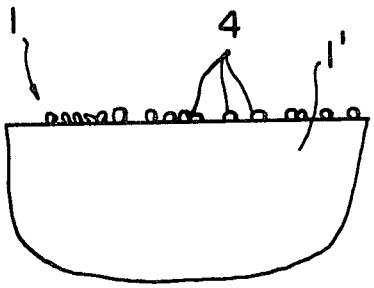
FIG. 2 (A) and (B) are sectional views showing the composition of the radioactive wastes.
Figure 2B:
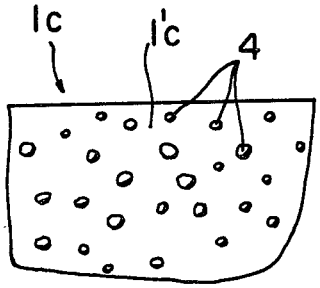

Referring now to FIG. 1, there is shown an incombustible radioactive solid waste generally designated as 1. The waste 1 includes large wastes 1*a* and small wastes 1*b* that may be put into a container 2, as shown. The wastes 1 further includes metals (such as pipes, valves, plates, die steels, and tools), waste filters (such as prefilters, HEPA filters) and inorganic materials (such as heat insulting material, fire-resisting material, glasses and concrete). It will be observed that the radioactive wastes 1 are contaminated by radioactivity such that as shown in FIG. 2 (A), the radioactive nuclides 4 are adhered to the surface of a solid 1′ which forms the pipe, filter, glass and the like as described above, which is well-known.

The wastes 1 are then melted in a melting furnace 5. Prior to this melting step, the large wastes 1*a* are demolished into smaller sizes by a size-reducing device 3 such as a plasma cutter, a hacksaw, and a press.

On the other hand, prior to the melting step, a container 6 is prepared. The container 6 used may be of the type capable of being used without modification for the purpose of storage as will be later described, that is, the type adapted for use without modification for the purpose of storage in view of the construction, dimensions, cost and durability. As for one example, the container comprises a canister 7 made of metal (such as iron) internally provided with a crucible 8 made of a refractory material (such as graphite, i.e. black lead). The container 6 is placed on a transport device 10 by means of a moving machine such as a crane 9. The transport device 10 comprises a movable truck 11, a cylinder 12 secured to the truck 11, a lower cover 13 mounted on the retractable rod 12*a* of the cylinder 12, and a tray 14. When the container 6 is placed on the tray 14 by the crane 9, the transport device 10 is moved under the furnace body 15 in a melting furnace 5. The cylinder 12 extends so that the lower cover 13 blocks a lower opening of the furnace body 15, and the container 6 is positioned to the required position within the furnace body 15.

The melting furnace 5 comprises a plasma torch 17, a lift 18 for moving the plasma torch up and down, a carrier 19 for the wastes and a cooler 20 for the container 6. The carrier 19 comprises a rail 21, a bucket 22 movable along the rail 21, and a cylinder 23 for moving the bucket 22. Reference numeral 24 designates a door, which is opened when the bucket 22 moves.

The radioactive wastes 1 are placed on the bucket 22 and carried into the furnace body 15. When the bottom plate of the bucket 22 is opened, the wastes are charged into the container 6 in its required position. In this case, the plasma torch 17 remains raised by the lift 18.

After the wastes 1 have been charged as described above, the bucket 22 is pulled out of the furnace and the plasma torch 17 is moved down. The wastes 1 within the container 6 are then heated by hot plasma arcs emitted from the plasma torch 17. In this manner, the wastes 1 are melted. The melt flows toward the bottom of the container 6 and stays thereon.

When the wastes 1 are melted in a manner as described above and the resultant melt stays on the bottom, a vacant space is formed in an upper portion in the container 6. Thus, the wastes 1 are again charged into the vacant space in a manner similar to the former and the melting operation is carried out. The melt produced by said melting operation is deposited on the melt resting on the bottom of the container 6 by the previous melting operation or on the solidified melt, or the first mentioned melt is mixed with the previous melt.

During the aforementioned operation, cooling air is blown from the cooler 20 towards the outer walls of the container to protect the container 6 from its overheating.

When the operation as described is repeatedly carried out several times to fill the required vacant space within the container 6 with the melt (or the solidified melt), the container 6 is carried out of the furnace 5 by the transport device 10. It should be noted that the wastes 1*c* (a different character is given for explanation because that state thereof is different from that before being molten) within the container 6 is solidifed prior to or in the midst of delivery.

It should be noted that the required vacant space in the container 6 includes the case of the entire vacant space within the container 6 or also the case of a few percent of the entire vacant space. This rate or percentage is suitably determined depending on the operations after the container is filled, for example, such as the storage, burying under the ground, and dumping into the seas.

It should be further noted that within the container 6 having been already filled with the wastes 1*c* by the above-mentioned operation, unmolten wastes 1 may be present while being immersed in the aforementioned melt or may be solidified together.

Next, a cover 25 is placed on the delivered container 6. This cover 25 is welded to the container 6 by a welder 26 to seal the interior of the container 6.

The thus sealed container 6 is then transported by truck or various other transporting means to a storing house 27, in which the container is stored until it is abandoned into the seas or otherwise finally disposed.

It should be noted that the radioactive wastes 1*c* packed into the container 6 as described above have been subjected to the melting operation as mentioned above, and thus, prior to melting, the radioactive nuclides 4 adhered to the surface of the solid material 1′ as shown in FIG. 2 (A) are buried and mixed into the solid material, and the nuclides 4 in the resolidified state become incorporated into the once molten and then solidified solid material 1′*c* as shown in FIG. 2 (B). Accordingly, the radioactive rays radiated from the nuclides 4 are partly intercepted by the solid material 1′*c*, and hence, the quantity of radioactive rays emerged externally of the container 6 decreases.

Figure 3:
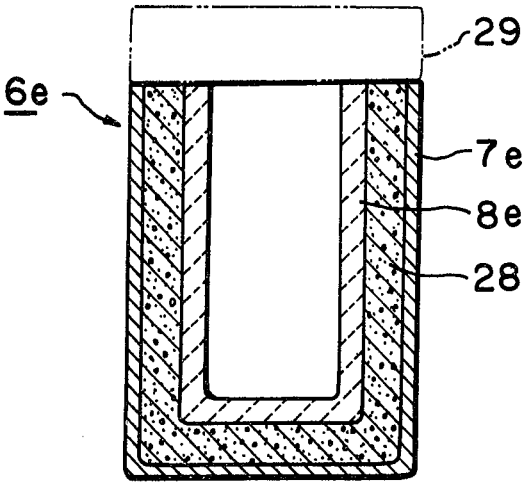
FIG. 3 is a longitudinal sectional view showing a different form of a container.

Next, FIG. 3 shows a container in a different form. This container 6*e* has a canister 7*e* and a crucible 8*e* between which is filled with concrete 28. A cover 29 comprises a metal outer plate lined with concrete. The thicknesses of both the concretes are determined in accordance with various objects as noted below.

(1) To set, to a value smaller than the required value, the amount of radioactive rays radiated from the wastes within the container, which radioactive rays pass through the container to leak externally of the container.

(2) To obtain strength to prevent damage during the transportation.

(3) To obtain strength to prevent damage in the sea, in case the wastes are dumped into the sea.

First, with respect to aforesaid paragraph (1), if the degree of radioactive contamination of the radioactive wastes introduced into the container is low, thin concrete will suffice. On the contrary, if the degree of contamination is high, thick concrete is necessary.

Next, with respect to paragraph (2), the container is carried, for example, by truck, or is loaded or unloaded for transportion or for storage at the storing site. Accordingly, the concrete must have adequate strength and be sufficiently durable against impacts received during such operations.

With respect to paragraph (3), a number of containers dumped into the sea possibly run against one another due to ocean currents or other causes. Accordingly, the concrete must have strength to be sufficiently durable against even the impact caused by such collision. In addition, since concrete is possibly compressed due to water pressure, the concrete must have strength to be sufficiently durable against the pressure.

In consideration of various requirements as noted above, the thickness of concrete selected is, for example, on the order of 12 cm. However, this is a mere example, and it is a matter of course that if the above-mentioned various requirements are taken into consideration, the thickness of concrete may be increased or decreased.

As many apparently widely different embodiments of this invention may be made without departing from the spirit and scope thereof, it is to be understood that the invention is not limited to the specific embodiments thereof except as defined in the appended claims.

We claim:

1. An apparatus, for filling a container with radioactive waste, comprising:

(i) a furnace body having a top wall with an opening therein and a side wall with an opening therein at an upper part thereof, said body being open at its lower part, (ii) a lower cover adapted, when in a raised position, to close said open lower part of the body, (iii) a container on said lower cover which becomes positioned in said body when said cover is in its raised position, (iv) means for raising and lowering said lower cover, (v) a bucket movable through said side wall opening between a first position in which it is outside said side wall of the furnace body, and a second position in which it is located above said container in said body, (iv) plasma torch means movable up and down through said top wall opening between a raised position in which said torch means are raised in said furnace body so that a lower end thereof becomes positioned above the level of said bucket, and a lowered position in which said lower end extends into said container when said container is positioned in said body.

2. An apparatus, as claimed in claim 1, comprising door means positioned for closing and opening said side wall opening.

3. An apparatus, as claimed in claim 1, comprising means in said furnace body for directing cooling gas onto said container in said furnace body.

4. An apparatus, as claimed in claim 1, wherein said container is lined with graphite.

5. An apparatus, as claimed in claim 1, wherein said container comprises an iron canister, a layer of concrete lining said canister, and a layer of graphite within said concrete forming a crucible.

* * * * *

UNITED STATES PATENT AND TRADEMARK OFFICE

CERTIFICATE OF CORRECTION

PATENT NO. : 4,432,942

DATED : February 21, 1984

INVENTOR(S) : Toshio Adachi et al.

It is certified that error appears in the above—identified patent and that said Letters Patent is hereby corrected as shown below:

On the title page Insert:

-- (73) Assignee: Daidotokushuko Kabushikikaisha
Japan --

Signed and Sealed this

*Twenty-first* Day of *May 1985*

[SEAL]

*Attest:*

DONALD J. QUIGG

*Attesting Officer* *Acting Commissioner of Patents and Trademarks*